US009688363B1

(12) United States Patent
Marshall et al.

(10) Patent No.: US 9,688,363 B1
(45) Date of Patent: Jun. 27, 2017

(54) WALKTHROUGH DOOR FOR MARINE VESSEL

(71) Applicant: Seabring Marine Industries, Inc., Williston, FL (US)

(72) Inventors: Jeffery Todd Marshall, Gainesville, FL (US); John Mark Owens, Merritt Island, FL (US)

(73) Assignee: Seabring Marine Industries, Inc., Williston, FL (US)

( * ) Notice: Subject to any disclaimer, the term of this patent is extended or adjusted under 35 U.S.C. 154(b) by 0 days.

(21) Appl. No.: 14/825,039

(22) Filed: Aug. 12, 2015

Related U.S. Application Data

(60) Provisional application No. 62/036,992, filed on Aug. 13, 2014.

(51) Int. Cl.
*B63B 29/02* (2006.01)
*B63B 17/02* (2006.01)
*B63B 19/02* (2006.01)

(52) U.S. Cl.
CPC ..... *B63B 29/02* (2013.01); *B63B 17/02* (2013.01); *B63B 19/02* (2013.01)

(58) Field of Classification Search
CPC ..... B63B 17/00; B63B 17/02; B63B 19/02; B63B 19/14
USPC ..... 114/201 R, 361
See application file for complete search history.

(56) References Cited

U.S. PATENT DOCUMENTS

| | | | | |
|---|---|---|---|---|
| 2,836,140 | A * | 5/1958 | Hunt, Jr. | B63B 19/02 114/201 R |
| 3,438,073 | A * | 4/1969 | Brown | B63B 17/02 114/361 |
| 5,203,277 | A * | 4/1993 | Norman | B63B 19/02 114/361 |
| 5,309,860 | A * | 5/1994 | Shearer | E05D 5/10 114/361 |
| D551,154 | S | 9/2007 | Metcalf | |
| D558,660 | S | 1/2008 | Malcore | |
| 7,401,568 | B2 | 7/2008 | Oebasto | |
| 7,430,981 | B2 | 10/2008 | Malcore | |
| D697,018 | S | 1/2014 | Rodgriguez | |
| D721,319 | S | 1/2015 | Kristinsson | |
| D721,632 | S | 1/2015 | Kristinsson | |
| 9,233,734 | B2 | 1/2016 | Erskine et al. | |
| 2007/0186839 | A1 | 8/2007 | Mercier | |
| 2008/0173229 | A1 | 7/2008 | Malcore | |
| 2008/0196653 | A1 | 8/2008 | Erskine | |

* cited by examiner

*Primary Examiner* — Lars A Olson
(74) *Attorney, Agent, or Firm* — Frijouf, Rust & Pyle P.A.

(57) ABSTRACT

An improved walkthrough door is disclosed for a marine vessel comprising a curved roof with a windshield disposed in the curved roof proximate a foredeck of the marine vessel. A transparent walkthrough door is slidably mounted in the curved roof and moveable between a closed position, whereat the walkthrough door seals with the foredeck and an open position permitting access to the foredeck. Preferably, the walkthrough door is electrically operated.

18 Claims, 9 Drawing Sheets

WALKTHROUGH DOOR FOR MARINE VESSEL

CROSS-REFERENCE TO RELATED APPLICATIONS

This application claims benefit of U.S. Patent Provisional application No. 62/036,992 filed Aug. 13, 2014. All subject matter set forth in provisional application No. 62/036,992 filed Aug. 13, 2014 is hereby incorporated by reference into the present application as if fully set forth herein.

BACKGROUND OF THE INVENTION

Field of the Invention

This invention relates to marine vessels and more particularly to an improved walkthrough door to permit access to a foredeck of the marine vessels.

Description of the Related Art

The versatility of runabout recreational vessels has led to the development of larger vessels having the same general configuration and features as the smaller version. These larger vessels, now known as sport yachts, offer the same versatility as runabouts, but with greater passenger capacity and increased accommodations.

One of the problems associated with both runabouts and sport yachts has been access to the foredeck. This problem required a person to climb over the windshield, or attempt to climb around the outside of the vessel on narrow side decks. One solution to the problem has been addressed primarily by a multi-sectional windshield with an opening center section. On larger sport yachts, opening a large center section of a windshield becomes a difficult task due to the windshield sections size and weight.

The addition of a hardtop further complicates the foredeck access issue. A hardtop is substantially a requirement on a sport yacht. A hardtop attached to a sectional windshield generally reduces the "window" area needed for foredeck access. Additionally structural considerations may require additional supports to prevent windshield flexing and potential failure of the windshield.

Access to the foredeck through an open windshield remains a problem unless a ladder or step system is provided inside the vessel. A means must also be provided to relocate the ladder to allow access to the cabin area beneath the foredeck.

There have been many in the prior art who have attempted to solve these problems with varying degrees of success. None, however completely satisfies the requirements for a complete solution to the aforestated problem.

Therefore, it is an object of the present invention to provide an improved walkthrough door to enable access to the foredeck of a vessel.

Another object of this invention is to provide an improved walkthrough door to enable easy access to the foredeck of a vessel by the user.

Another object of this invention is to provide an improved walkthrough door to enable access to the foredeck of a vessel that is cost effective to produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved walkthrough door for a marine vessel. The marine vessel has a vessel hull partially covered by a foredeck and a pilot station located aft of the foredeck. The improved walkthrough door comprises a curved roof extending between a forward end and an aft end. The curved roof is secured to the vessel hull with the forward end of the curved roof disposed proximate the foredeck and with the aft end of the curved roof covering the pilot station. A windshield is disposed in the curved roof for sealing with the foredeck of the marine vessel. A walkthrough door is slidably mounted in the curved roof and moveable between a closed position whereat the walkthrough door seals with the foredeck of the marine vessel and an open position permitting access to the foredeck.

In another embodiment, the invention is incorporated into a curved roof secured relative to the vessel hull extending between a forward end and an aft end. The curved roof comprises a port support and a starboard support. A depression is formed in the curved roof between the port support and the starboard support. A walkthrough door flame extends intermediate the port support and a starboard support. A port fixed windshield is secured between the port support and the walkthrough door frame and a starboard fixed windshield is secured between the starboard support and the walkthrough door frame. A walkthrough door is slidably mounted in the walkthrough door frame and moveable between a closed position whereat the door seals in proximately to the foredeck and an open position permitting access to the foredeck.

In another embodiment, the invention is incorporated into a curved roof extending between a forward end and an aft end. The curved roof is secured to the vessel hull with the forward end of the curved roof sealing with the foredeck and the aft end covering the pilot station. An aperture is defined in the curved roof. A port and a starboard windshield are disposed in a port and a starboard portion of the aperture. A walkthrough door is slidably mounted in central portion of the aperture between a closed position whereat the walkthrough door seals with the foredeck and an open position permitting access to the foredeck. A motor is connected to the walkthrough door for moving the walkthrough door between the closed position and the open position.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
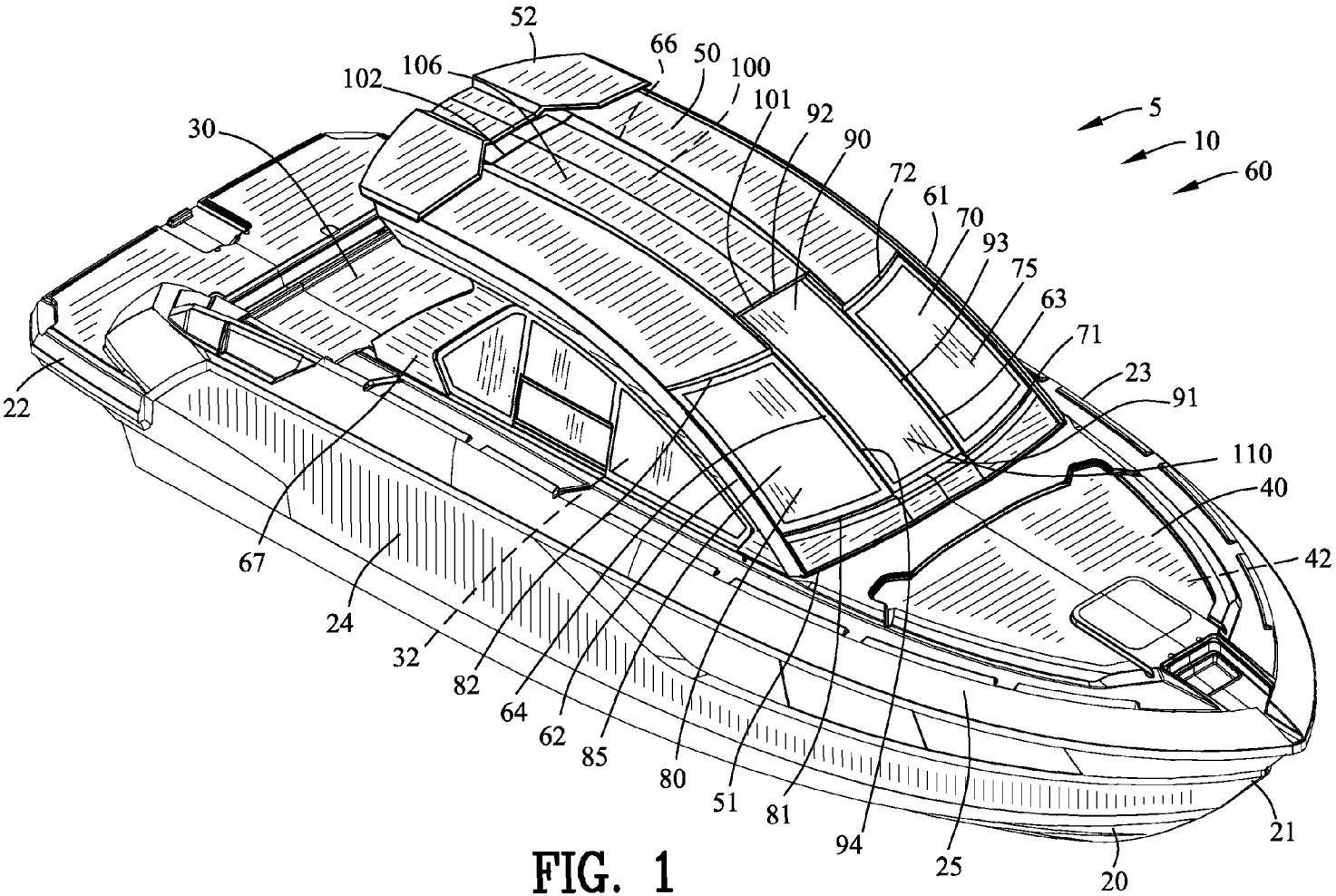
FIG. 1 is an isometric view of a marine vessel incorporating the improved walkthrough door of the present invention shown in a closed position.
Figure 2:
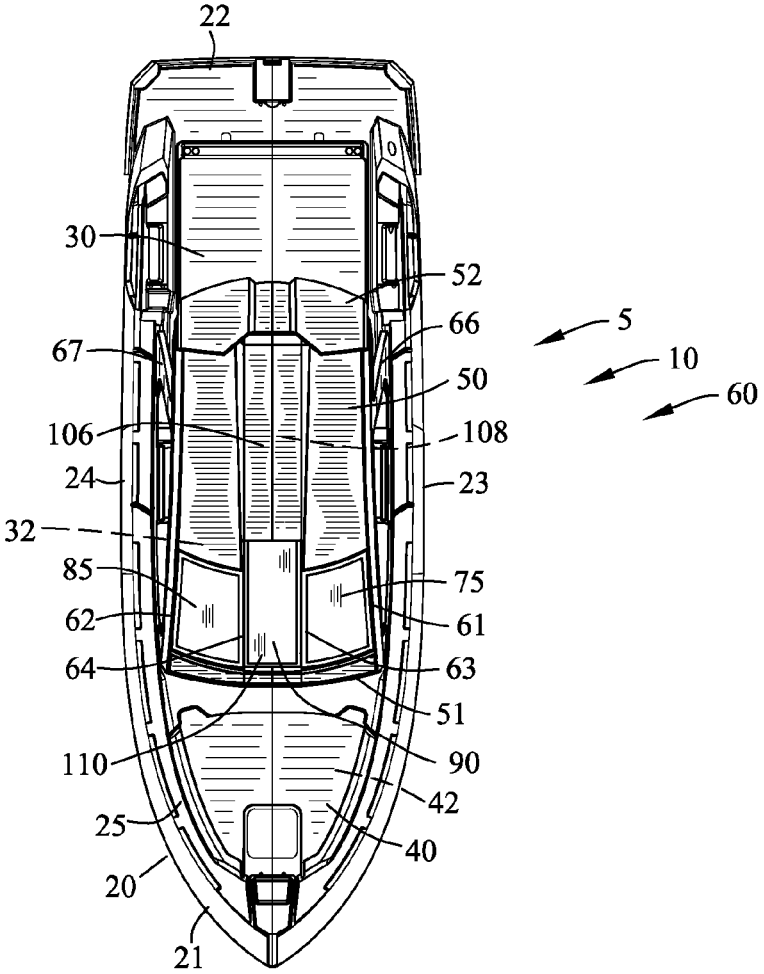
FIG. 2 is a top view of FIG. 1.
Figure 3:
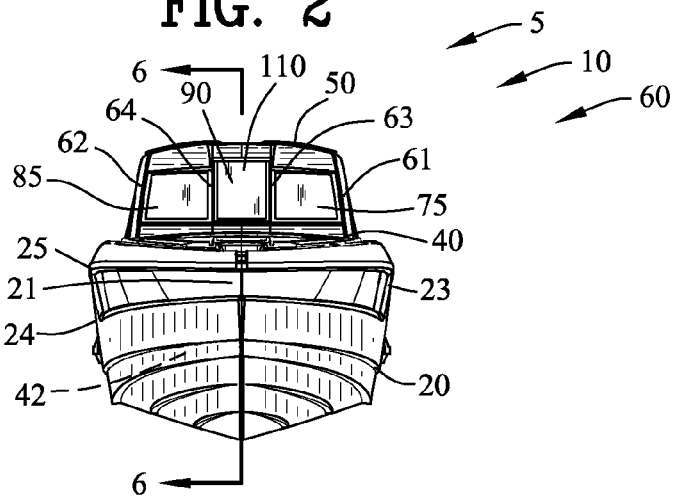
FIG. 3 is a front view of FIG. 1.

FIGS. 1-6 are various views of a walkthrough door 5 of the present invention installed on a marine vessel 10. The marine vessel comprises a hull 20 having a bow 21, a stern 22, a port side 23 and a starboard side 24. The hull 20 defines a gunwale 25 about an upper periphery of the hull 20.

Figure 5:
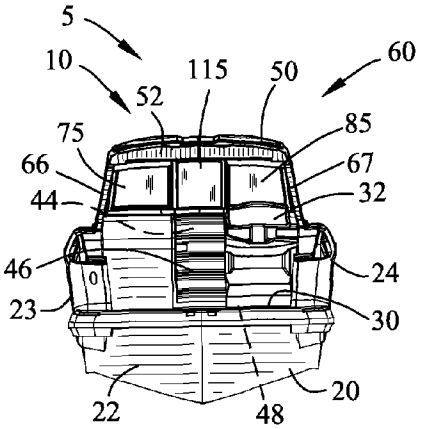
FIG. 5 is a rear view of FIG. 4.
Figure 6:
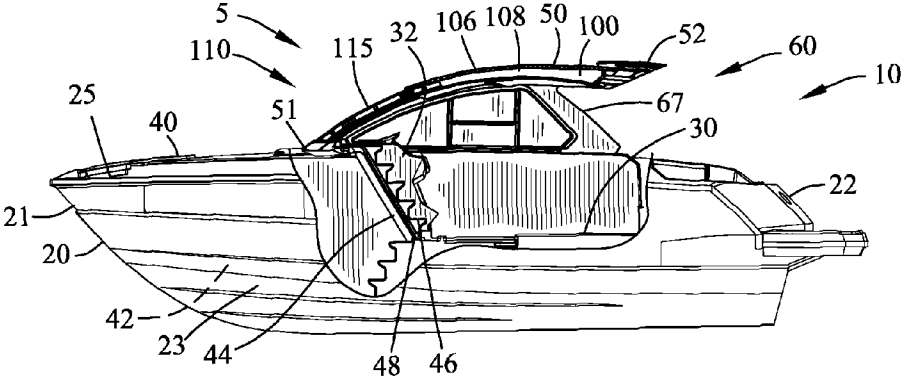
FIG. 6 is a sectional view along line 6-6 in FIG. 3.

The hull 20 supports a floorboard 30 extending from a pilot station 32 to the stern 22 of the hull 20. A foredeck 40 is secured to the gunwale 25 and extends from the bow 21 toward the pilot station 32. The hull 20 and the foredeck 40 define a forward cabin 42. As best shown in FIGS. 5 and 6, a companionway 44 permits access to the forward cabin 42. In this example, a stairway 46 functions as a hatch for closing and opening the forward cabin 42. As will be described in greater detail hereinafter, the stairway 46 is provided with slide tracks 48 for moving the stairway 46 between a closed position and an open position.

Figure 7:
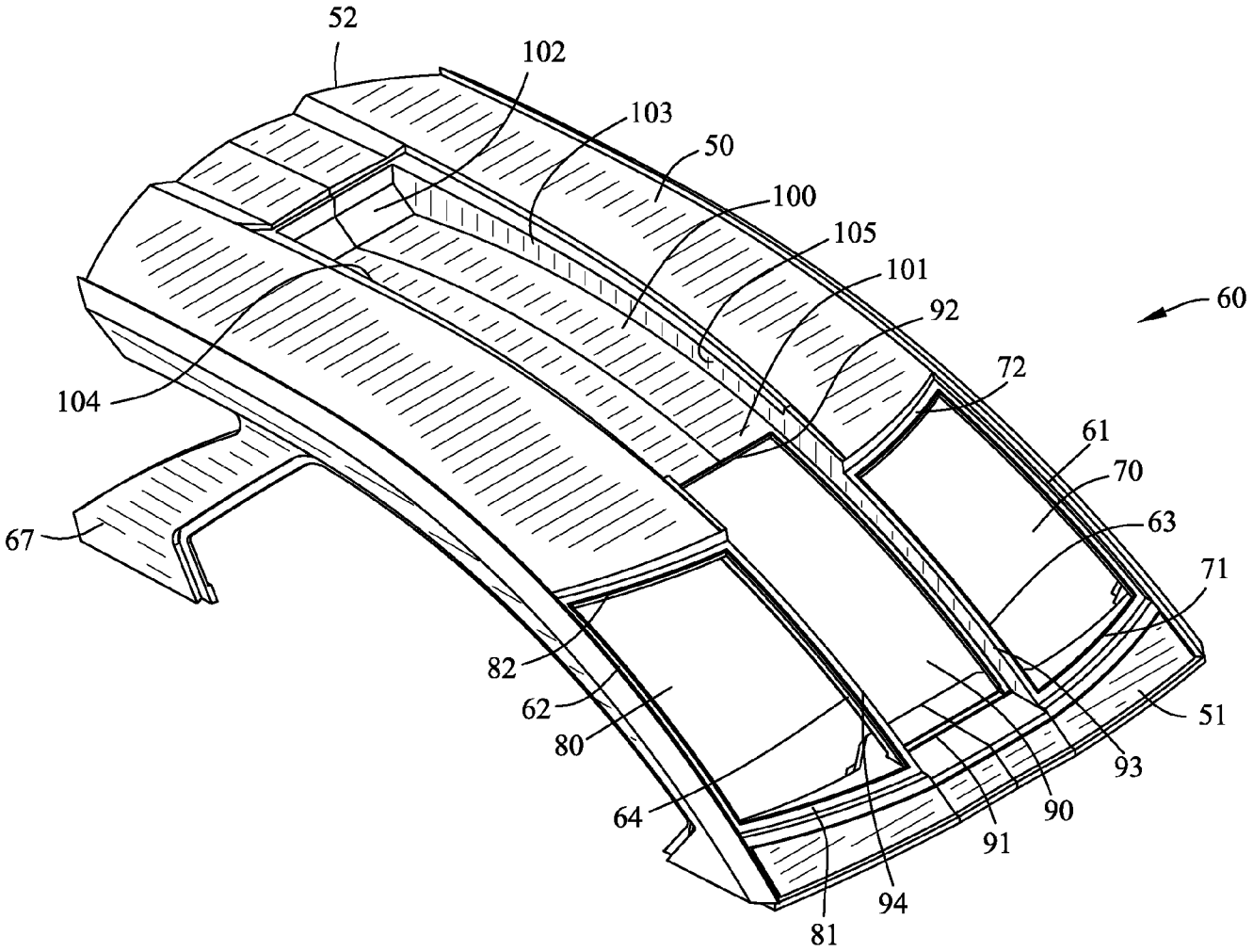
FIG. 7 is an isometric view of a one-piece curved roof for receiving the walkthrough door of the present invention.

FIG. 7 is an enlarged isometric view of a curved roof 50 which forms a part of the present invention. The curved roof 50 extends from a forward end 51 to an aft end 52. The forward end 51 of the curved roof 50 is disposed proximate the foredeck 40 shown in FIGS. 1-6 with the aft end 52 of the curved roof 50 extending beyond the pilot station 32.

Figure 4:
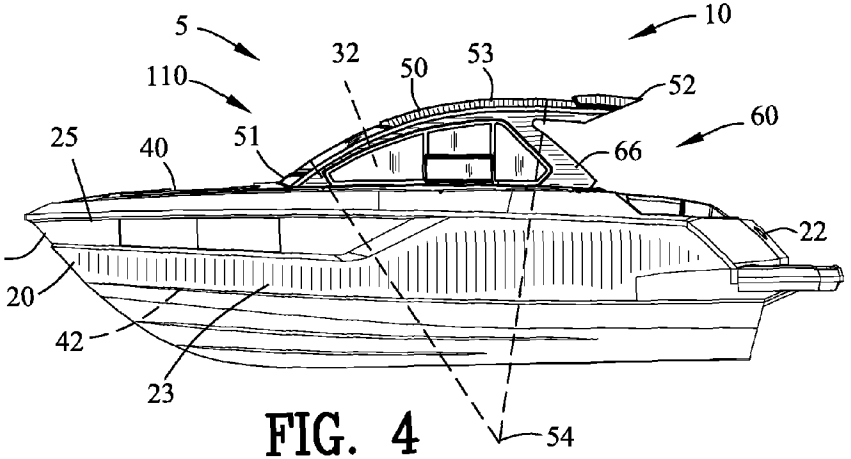
FIG. 4 is a port side view of FIG. 3.

As best shown in FIG. 4, the curved roof 50 is formed as a minor arc 53 of a circle having a center of a radius of curvature 54. The radius of curvature 54 is selected for proper operation of the walkthrough door 5 as well for aesthetic appearances of the aspect ratio of the curved roof 50 relative to the hull 20. For a sports yacht having a hull length of 30 to 40 feet, the radius of curvature 54 of the minor arc is between 160 and 220 inches. Preferably, the radius of curvature 54 is 175 inches.

A plurality of supports 60 are incorporated into the curved roof 50. The plurality of supports 60 include a port support 61, a starboard support 62, a port intermediate support 63 and a starboard intermediate support 64. The supports 61-64 provide attachments for the forward end 51 of the curved roof 50 to the marine vessel 10. Preferably, the curved roof 50 and the supports 61-64 are formed as a one-piece unit from a polymeric material such as fiberglass, carbon fiber or any other suitable material. A port aft support 66 and a starboard aft support 67 provide attachments for the aft end 52 of the curved roof 50 to the marine vessel 10.

The port support 61 and the port intermediate support 63 define a port aperture 70 having a forward end 71 and an aft end 72. The port aperture 70 receives a port windshield 75. Similarly, a starboard support 62 and a starboard intermediate support 64 define a starboard aperture 80 having a forward end 81 and an aft end 82. The starboard aperture 80 receives a starboard windshield 85.

A central aperture 90 is defined between the port intermediate support 63 and the starboard intermediate support 64. The central aperture 90 extends from a forward end 91 to an aft end 92 between a port side 93 and a starboard side 94

A depression 100 extends from a forward end 101 to an aft end 102 of the curved roof 50 and is bound by a port edge 103 and a starboard edge 104. The depression 100 is integrally molded into the curved roof 50. The central aperture 90 extends into the depression 100 and defines a walkthrough door respite 105. The walkthrough door respite 105 extends about the periphery of the central aperture 90. A cover 106 is secured to the curved roof 50 for covering the top of the depression 100 thereby creating a pocket 108.

Figure 8:
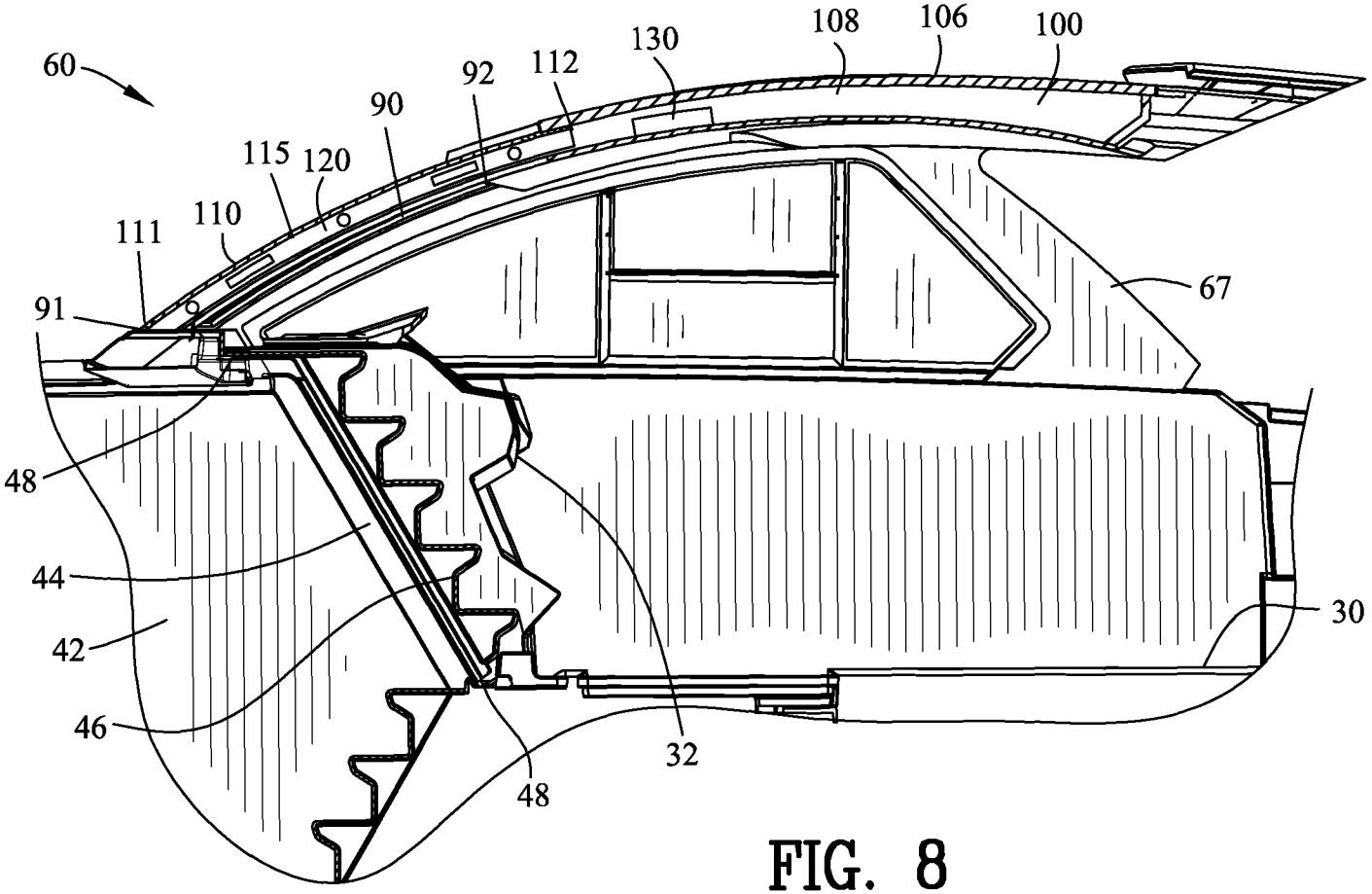
FIG. 8 is an enlarged view of FIG. 6.

FIG. 8 is an enlarged view of FIG. 6 illustrating a walkthrough door 110. The walkthrough the door 110 is bounded by forward end 111, an aft end 112, a port side 113 and a starboard side 114. A transparent window door 115 is secured within the boundary 111-114 of the walkthrough the door 110. As best shown in FIG. 8, the walkthrough the door 110 including the transparent window door 115 is curved to conform to the radius of curvature of the curved roof 50 as illustrated in FIG. 4.

The walkthrough the door 110 is slidably mounted to a walkthrough door frame 120. As best shown in FIG. 8, the walkthrough door frame 120 is curved to conform to the radius of curvature of the curved roof 50 illustrated in FIG. 4.

The walkthrough door frame 120 is permanently mounted within the walkthrough door respite 105 of the curved roof 50 to cover the central aperture 90. A cover 106 is secured to the curved roof 50 for covering the top of the depression 100 thereby creating a pocket 108 for receiving the walkthrough door 110 therein.

FIGS. 1 and 8 illustrate the walkthrough door 110 in a closed position. In the closed position, the walkthrough door 110 seals with the foredeck 40 of the marine vessel 10. The walk-through door 110 operates in concert with the port and starboard windshields 75 and 85 to provide visibility and protection to a pilot and occupants of the marine vessel 10 from sea spray, wind, rain and the like.

Figure 9:
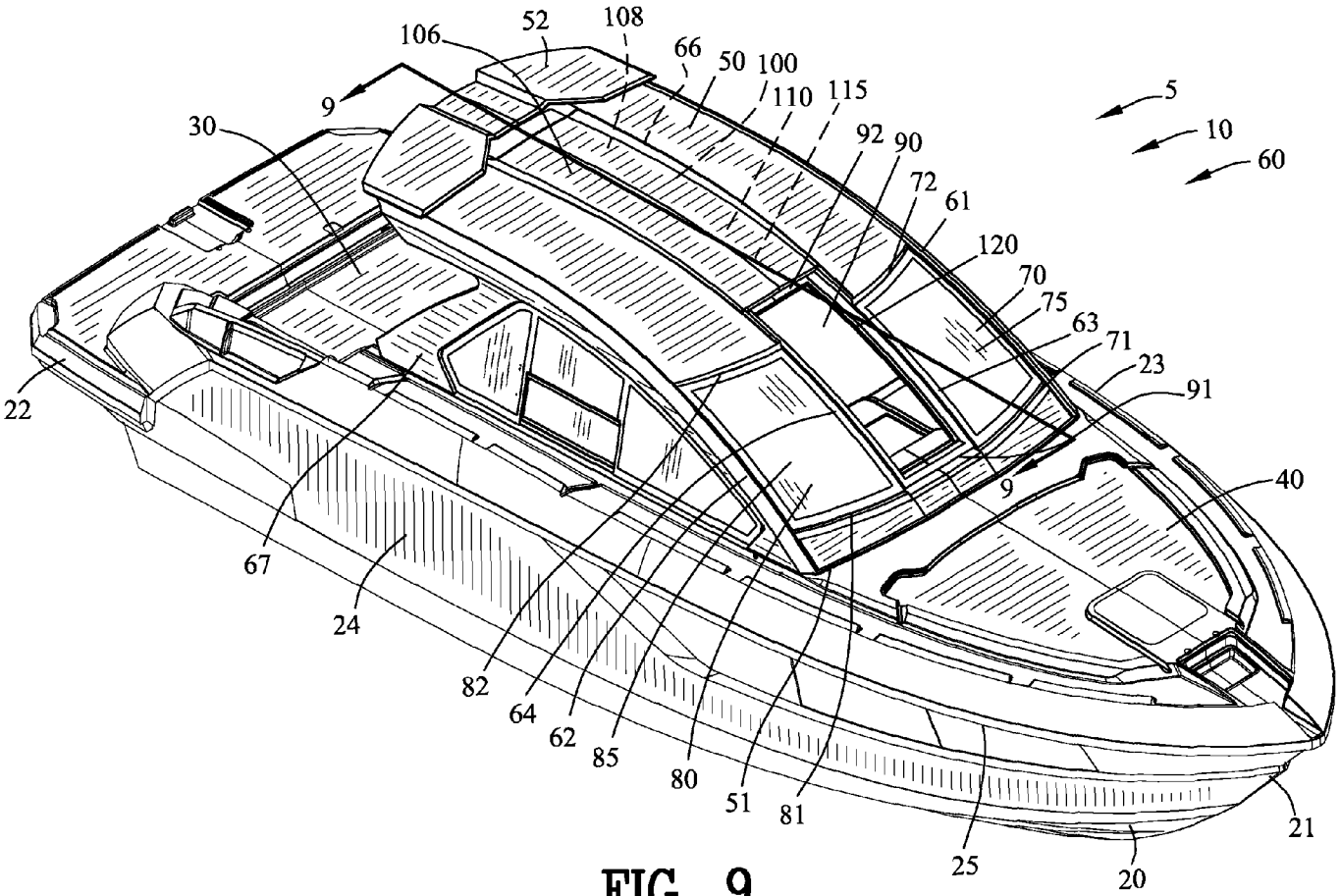
FIG. 9 is a view similar to FIG. 1 with the walkthrough door shown in an open position.
Figure 10:
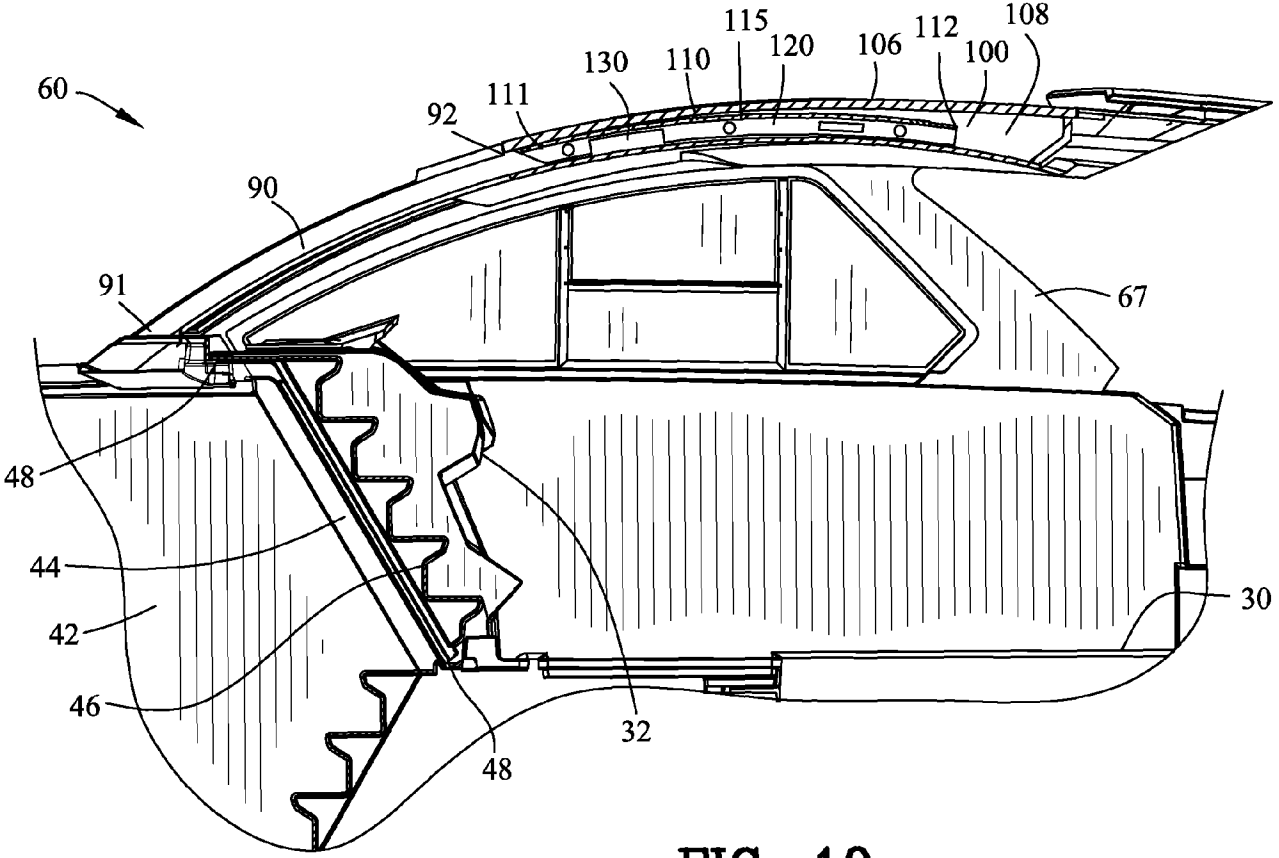
FIG. 10 is a view similar to FIG. 8 with the walkthrough door shown in an open position.

FIGS. 9 and 10 illustrate the walkthrough door 110 in an open position. The walkthrough door 110 is slid upwardly and backwardly along the walkthrough door frame 120 to place the walkthrough door 110 into the open position. In the open position, the walkthrough the door 110 is move into the depression 100 to be received within the pocket 108. In the open position, a person may walk through the walkthrough door 110 and gain access to and from the foredeck 40.

An important aspect of the present invention includes the walkthrough door 110 being curved in accordance with the curved roof 50. The walkthrough door 110, the transparent window 115 and the walkthrough door frame 120 are curved in accordance with the curved roof 50. Preferably, the walkthrough door 110, the transparent window 115 and the walkthrough door frame 120 have the same radius of curvature 54 as the curved roof 50.

Preferably, a motor 130 is connected to the walkthrough door 110 for moving the walkthrough door 110 between the closed position and the open position. The motor 130 may include an electrically operated motor or a hydraulically operated motor with an appropriate drive coupling to the walkthrough door 110.

FIGS. 11-14 are various views of the stairway 46 illustrating the ability of moving the stairway 46 between a closed position and an open position. The movement of the stairway 46 may be manual or automatic through the use of an electrically or hydraulically operated motor (not shown).

Figure 11:
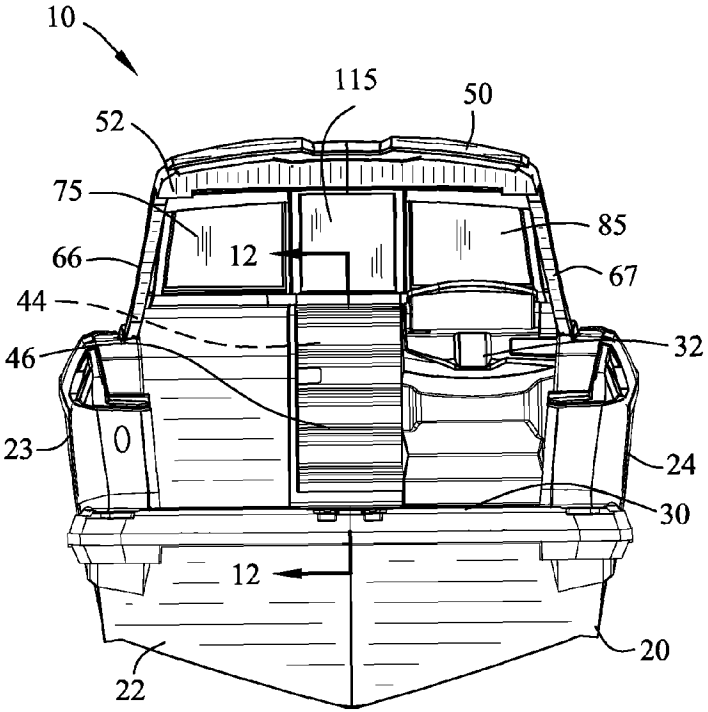
FIG. 11 is an enlarged rear view illustrating stairs located adjacent to the walkthrough door and closing access to a forward cabin below a foredeck.

FIG. 11 illustrates the stairway 46 in a closed position. In the closed position, the stairway 46 functions as a hatch for closing the companionway 44 of the fore cabin 42. In addition, the stairway 46 facilitates movement to and from the floorboard 30 and the foredeck 40 through the central aperture 90.

Figure 12:
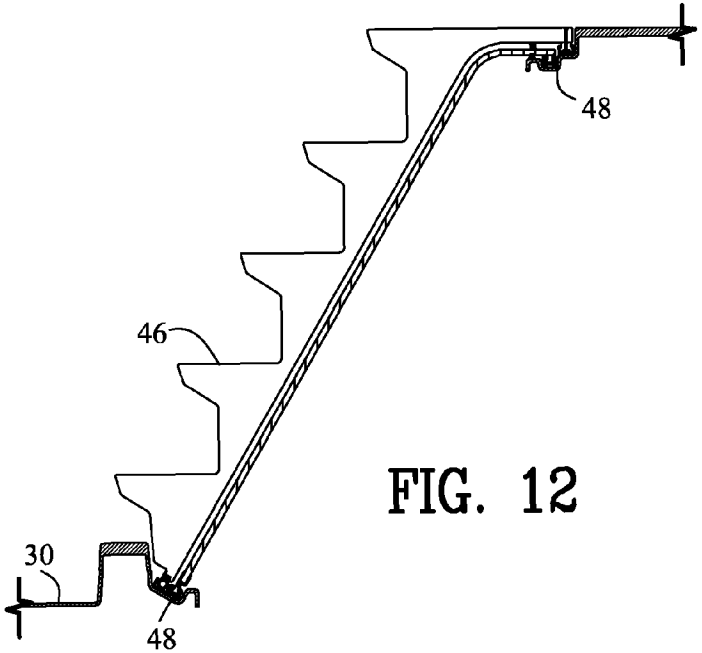
FIG. 12 is an enlarged side sectional view of the stairs shown in FIG. 11.

FIG. 12 illustrates the stairway 46 mounted on slide tracks 48 for laterally moving the stairway 46 between a closed position and an open position.

Figure 14:
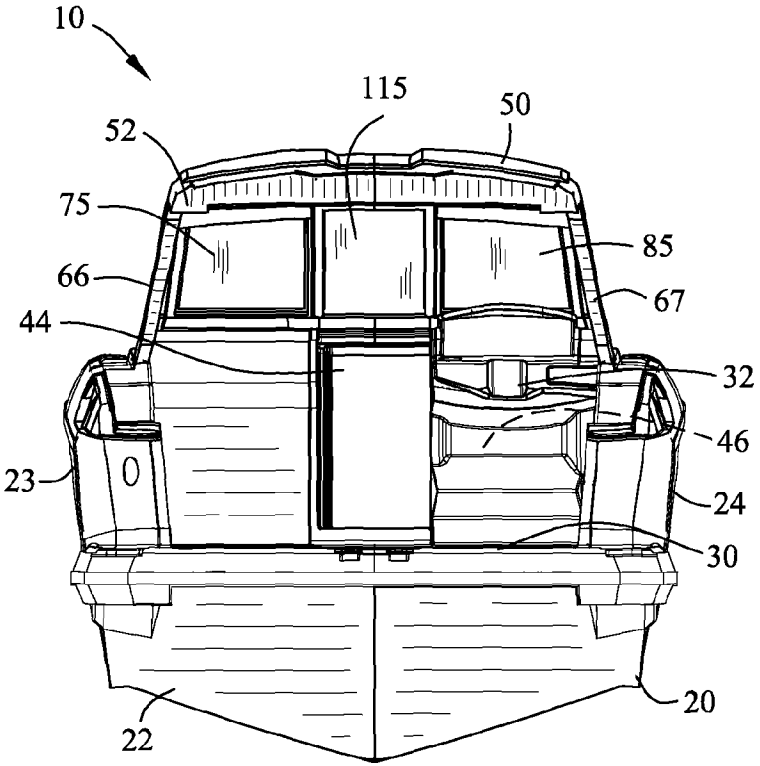
FIG. 14 is view similar to FIG. 13 illustrating the stairs in an open position permitting access to a forward cabin below a foredeck.
Figure 13:
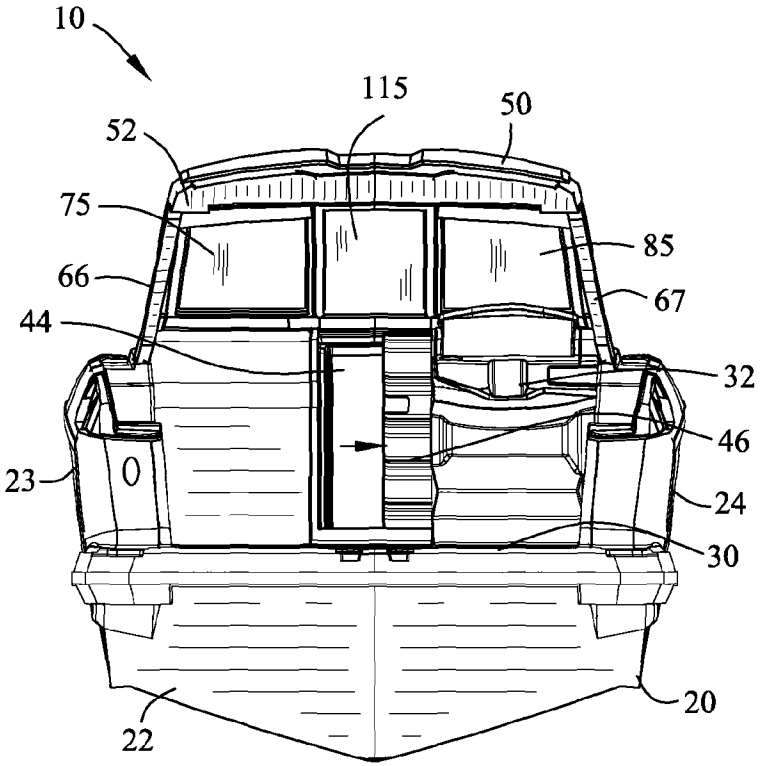
FIG. 13 is view similar to FIG. 11 illustrating the stairs in a partially open position.

FIGS. 13 and 14 illustrate the stairway 46 in a partially open position and an open position, respectively. In the open position, the stairway 46 is stowed behind the pilot station 32. The open companion way 44 permits ingress and egress with the fore cabin 42.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved walkthrough door for a marine vessel, the marine vessel having a vessel hull partially covered by a foredeck and a pilot station located aft of the foredeck, comprising:

a curved roof extending between a forward end and an aft end;

said curved roof secured to the vessel hull with said forward end of said curved roof disposed proximate the foredeck and with said aft end of said curved roof covering the pilot station;

said curved roof having a depression defined in a top side of said curved roof;

a windshield disposed in curved roof for sealing with the foredeck of the marine vessel; and a walkthrough door slidably mounted in said depression of said curved roof and moveable between a closed position whereat said walkthrough door seals with the foredeck of the marine vessel and an open position permitting access to the foredeck.

2. An improved walkthrough door for a marine vessel as set forth in claim 1, wherein said walkthrough door is curved in accordance with said curved roof.

3. An improved walkthrough door for a marine vessel as set forth in claim 1, wherein said walkthrough door includes a transparent window.

4. An improved walkthrough door for a marine vessel as set forth in claim 1, wherein said windshield is curved in accordance with said curved roof.

5. An improved walkthrough door for a marine vessel the marine vessel having a vessel hull partially covered by a foredeck and a pilot station located aft of the foredeck, comprising:

a curved roof extending between a forward end and an aft end;

said curved roof secured to the vessel hull with said forward end of said curved roof disposed proximate the foredeck and with said aft end of said curved roof covering the pilot station;

a windshield disposed in said curved roof for sealing with the foredeck of the marine vessel;

a walkthrough door slidably mounted in said curved roof and moveable between a closed position whereat said walkthrough door seals with the foredeck of the marine vessel and an open position permitting access to the foredeck; and said walkthrough door is electrically operated for movement between said closed position and said open position.

6. An improved walkthrough door for a marine vessel, the marine vessel having a vessel hull partially covered by a foredeck and a pilot station located aft of the foredeck, comprising:

a curved roof extending between a forward end and an aft end;

said curved roof secured to the vessel hull with said forward end of said curved roof disposed proximate the foredeck and with said aft end of said curved roof covering the pilot station;

a windshield disposed in said curved roof for sealing with the foredeck of the marine vessel;

a walkthrough door slidably mounted in said curved roof and moveable between a closed position whereat said walkthrough door seals with the foredeck of the marine vessel and an open position permitting access to the foredeck; and a step located adjacent to said walkthrough door for facilitating ingress and egress though said walkthrough door.

7. An improved walkthrough door for a marine vessel, the marine vessel having a vessel hull partially covered by a foredeck and a pilot station located aft of the foredeck, comprising:

a curved roof extending between a forward end and an aft end;

said curved roof secured to the vessel hull with said forward end of said curved roof disposed proximate the foredeck and with said aft end of said curved roof covering the pilot station;

a windshield disposed in said curved roof for sealing with the foredeck of the marine vessel;

a walkthrough door slidably mounted in said curved roof and moveable between a closed position whereat said walkthrough door seals with the foredeck of the marine vessel and an open position permitting access to the foredeck;

a step located adjacent to said walkthrough door for facilitating ingress and egress though said walkthrough door; and said step being movable for permitting ingress and egress below the foredeck.

8. An improved walkthrough door for a marine vessel as set forth in claim 1, wherein said curved roof forms a minor arc of a circle.

9. An improved walkthrough door for a marine vessel the marine vessel having a vessel hull partially covered by a foredeck and a pilot station located aft of the foredeck, comprising:

a curved roof extending between a forward end and an aft end;

said curved roof secured to the vessel hull with said forward end of said curved roof disposed proximate the foredeck and with said aft end of said curved roof covering the pilot station;

a windshield disposed in said curved roof for sealing with the foredeck of the marine vessel;

a walkthrough door slidably mounted in said curved roof and moveable between a closed position whereat said walkthrough door seals with the foredeck of the marine vessel and an open position permitting access to the foredeck; and said curved roof forming a minor arc of a circle having a radius between 160 and 220 inches.

10. An improved walkthrough door for a marine vessel as set forth in claim 1, wherein said curved roof forms a minor are of a circle having a radius of 175 inches.

11. An improved walkthrough door for a marine vessel as set forth in claim 1, including a port and starboard support extending between said curved roof and said hull for supporting an aft portion of said curved roof.

12. An improved walkthrough door for a marine vessel as set forth in claim 1, wherein said curved roof is molded as a one piece unit.

13. An improved walkthrough door for a marine vessel as set forth in claim 1, including a cover for covering said depression for enclosing said walkthrough door when said walkthrough door is in an open position.

14. An improved walkthrough door for a marine vessel, the marine vessel having a vessel hull partially covered by a foredeck and a pilot station located aft of the foredeck, comprising:

a curved roof extending between a forward end and an aft end;

said curved roof secured to said vessel hull with said forward end of said curved roof sealing with the foredeck and said aft end covering the pilot station;

an aperture defined in said curved roof;

a port and a starboard windshield disposed in a port and a starboard portion of said aperture;

a walkthrough door slidably mounted in central portion of said aperture between a closed position whereat said walkthrough door seals with the foredeck and an open position permitting access to the foredeck; and a motor connected to said walkthrough door for moving said walkthrough door between said closed position and said open position.

15. An improved walkthrough door for a marine vessel as set forth in claim 14, wherein said curved roof is formed as a one piece unit.

16. An improved walkthrough door for a marine vessel as set forth in claim 14, wherein said curved roof forms a minor arc of a circle.

17. An improved walkthrough door for a marine vessel as set forth in claim 14, wherein said curved roof forms a minor arc of a circle having a radius between 160 and 220 inches.

18. An improved walkthrough door for a marine vessel as set forth in claim 14, wherein said curved roof forms a minor arc of a circle having a radius of 175 inches.

* * * * *